US008800313B2

(12) United States Patent
Woo et al.

(10) Patent No.: US 8,800,313 B2
(45) Date of Patent: Aug. 12, 2014

(54) WATER CIRCULATION SYSTEM ASSOCIATED WITH REFRIGERANT CYCLE

(75) Inventors: Hyoung Suk Woo, Changwon (KR); Jae Sun Song, Changwon (KR)

(73) Assignee: LG Electronics Inc., Seoul (KR)

( * ) Notice: Subject to any disclaimer, the term of this patent is extended or adjusted under 35 U.S.C. 154(b) by 981 days.

(21) Appl. No.: 12/729,535

(22) Filed: Mar. 23, 2010

(65) Prior Publication Data

US 2011/0155356 A1 Jun. 30, 2011

(30) Foreign Application Priority Data

Dec. 31, 2009 (KR) ..... 10-2009-0136006

(51) Int. Cl.
*F28D 7/10* (2006.01)
*F25B 7/00* (2006.01)

(52) U.S. Cl.
USPC ..... 62/336; 165/141

(58) Field of Classification Search
USPC ..... 62/335; 165/141, 61, 62, 63, 64, 65
See application file for complete search history.

(56) References Cited

U.S. PATENT DOCUMENTS

| | | | | |
|---|---|---|---|---|
| 1,798,330 | A * | 3/1931 | Leek | 165/141 |
| 3,774,678 | A * | 11/1973 | Glorisi | 165/76 |
| 3,788,281 | A * | 1/1974 | Van Lookeren | 122/7 R |
| 3,983,932 | A * | 10/1976 | Yamaguchi et al. | 165/154 |
| 6,119,479 | A * | 9/2000 | Roberts et al. | 62/612 |
| 7,842,255 | B2 * | 11/2010 | Pennino | 422/198 |
| 7,918,104 | B2 * | 4/2011 | Park et al. | 62/325 |
| 8,490,606 | B2 * | 7/2013 | Zeitoun | 123/568.11 |
| 2003/0024262 | A1 * | 2/2003 | Mosemann et al. | 62/335 |
| 2004/0065095 | A1 * | 4/2004 | Osborne et al. | 62/160 |
| 2009/0107656 | A1 * | 4/2009 | Marois | 165/104.19 |
| 2010/0077788 | A1 * | 4/2010 | Lewis | 62/324.6 |
| 2010/0243202 | A1 * | 9/2010 | Han et al. | 165/62 |
| 2011/0154844 | A1 * | 6/2011 | Lee et al. | 62/278 |
| 2011/0197599 | A1 * | 8/2011 | Stewart et al. | 62/56 |
| 2013/0180275 | A1 * | 7/2013 | Bonne et al. | 62/118 |

FOREIGN PATENT DOCUMENTS

| | | | |
|---|---|---|---|
| CN | 201050953 | Y | 4/2008 |
| DE | 33 18 722 | A1 | 11/1984 |
| EP | 0 302 231 | A2 | 2/1989 |
| EP | 1 394 482 | A2 | 3/2004 |
| JP | 63-156992 | A | 6/1988 |
| JP | 2007-178090 | A | 7/2007 |
| JP | 2007-232282 | A | 9/2007 |
| JP | 2008-157558 | A | 7/2008 |

OTHER PUBLICATIONS

Chinese Office Action dated Sep. 26, 2012 issued in Application No. 201010190594.9.
European Search Report dated Nov. 23, 2012 issued in Application No. 10 25 0863.
Korean Office Action dated Feb. 20, 2103 issued in Application No. 10-2009-0136006.

* cited by examiner

*Primary Examiner* — Ljiljana Ciric
*Assistant Examiner* — Alexis Cox
(74) *Attorney, Agent, or Firm* — KED & Associates, LLP

(57) ABSTRACT

A water circulation system associated with a refrigerant cycle that includes an intermediate heat exchanger having a triple-pipe shape in which three independent flow passages are formed by three pipes having a concentric axis and different diameters. Accordingly, three fluids flowing through the three independent flow passages can exchange heat with each other at the same time through the intermediate heat exchanger and heat exchange capacity of the intermediate heat exchanger can selectively be varied.

15 Claims, 6 Drawing Sheets

WATER CIRCULATION SYSTEM ASSOCIATED WITH REFRIGERANT CYCLE

BACKGROUND OF THE INVENTION

1. Field of the Invention

The present invention relates to an indoor unit of a water circulation system performing a hot water supplying function and cooling and heating functions in association with a refrigerant cycle.

2. Description of the Related Art

In the related art, indoor cooling and heating are performed by an air conditioner using the refrigerant cycle and supplying hot water is performed by a boiler with an additional heating source.

More specifically, the air conditioner includes an outdoor unit installed in an outdoor area and an indoor unit installed in an indoor area. The outdoor unit includes a compressor compressing refrigerant, an outdoor heat exchanger for exchanging heat of outdoor air with the refrigerant, and a decompressing device and the indoor unit includes an indoor heat exchanger for exchanging heat of indoor air with the refrigerant. At this time, any one of the outdoor heat exchanger and the indoor heat exchanger serves as a condenser and the other one serves as an evaporator and the compressor, the outdoor heat exchanger, the decompressing device, and the indoor heat exchanger perform a refrigerant cycle.

In addition, the boiler generates heat by using oil, gas, or electricity and heats water to supply hot water or perform floor heating.

SUMMARY OF THE INVENTION

The present invention provides a water circulation system associated with a refrigerant cycle that includes an intermediate heat exchanger having a triple-pipe shape in which three independent flow passages are formed by three pipes having a concentric axis and different diameters. According to an embodiment of the present invention, a first refrigerant circulation unit where first refrigerant exchanging heat with indoor air flows to perform the refrigerant cycle;

a second refrigerant circulation unit where second refrigerant exchanging heat with the first refrigerator flows to perform the refrigerant cycle;

a water circulation unit where water for at least one of indoor cooling and heating and hot water supplying; and a heat exchanger with three flow passages where the first refrigerant, the second refrigerant, and the water independently flow through three pipes having a concentric axis and different diameters in order to exchange heat among the first refrigerant, the second refrigerant, and the water. Accordingly, according to an embodiment of the present invention, three fluids can exchange heat with each other at the same time through the intermediate heat exchanger and the heat exchange capacity of the intermediate heat exchanger is selectively variable.

DETAILED DESCRIPTION OF THE PREFERRED EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
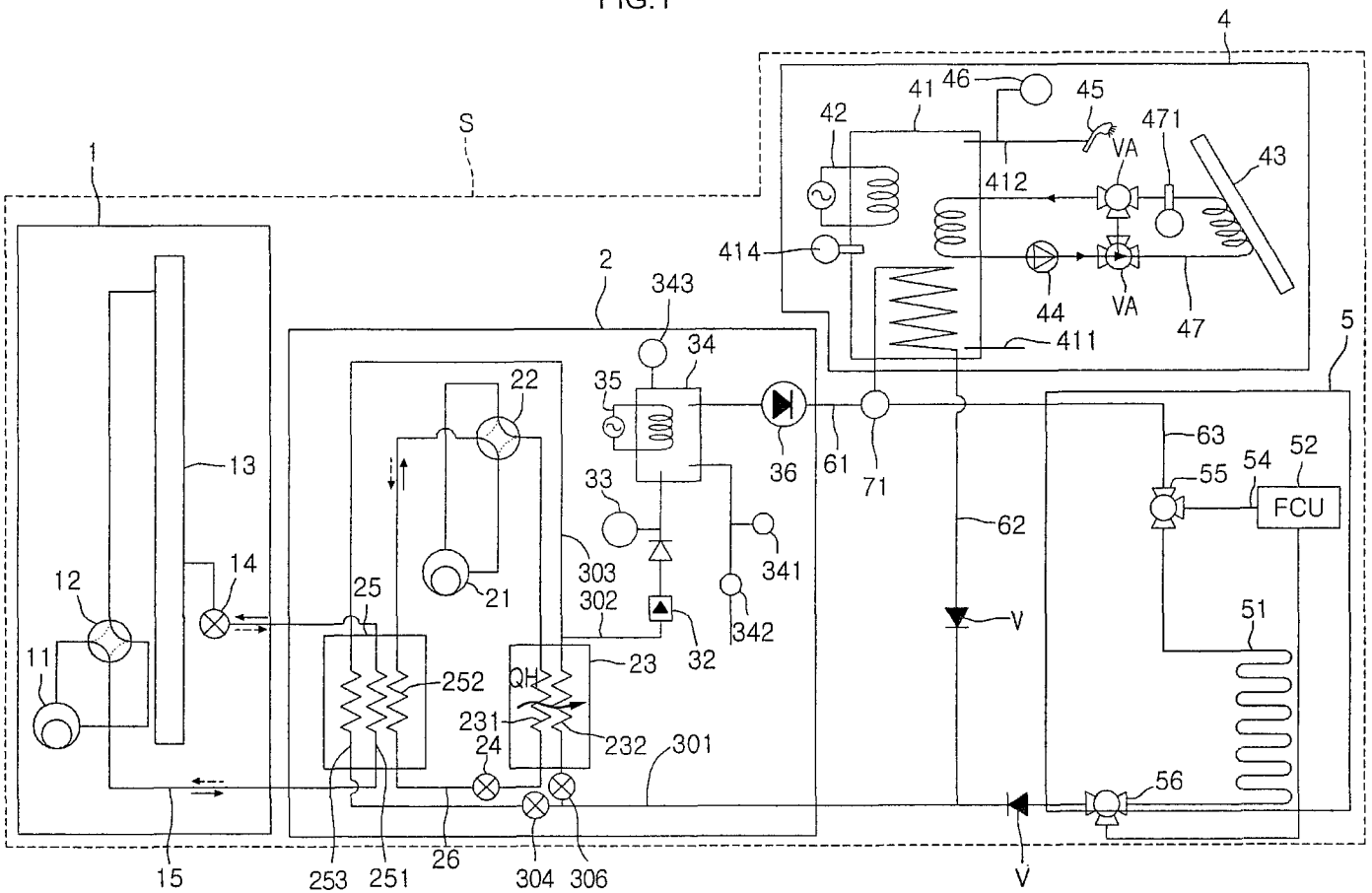
FIG. 1 is a configuration diagram of a first embodiment of a water circulation system associated with a refrigerant cycle according to the present invention.

FIG. 1 is a configuration diagram of a first embodiment of a water circulation system associated with a refrigerant cycle according to the present invention.

Referring to FIG. 1, the water circulation system S associated with the refrigerant cycle includes a first refrigerant circulation unit where first refrigerant exchanging heat with outdoor air flows to perform the refrigerant cycle, a second refrigerant circulation unit where second refrigerant exchanging heat with the first refrigerant flows to perform the refrigerant cycle, and a water circulation unit where water for at least one of indoor heating/cooling and hot water supplying. At this time, the refrigerant cycle means transmitting the heat by repetitively performing compression, condensation, expansion, and evaporation processes.

In addition, the water circulation system S associated with the refrigerant cycle includes an outdoor unit 1 where an outdoor heat exchanger 13 exchanging the first refrigerant and the outdoor air with each other is installed and an intermediator 2 that intermediates the outdoor 1 with the water circulation unit and includes a water refrigerant heat exchanger 23 exchanging heat between the second refrigerant and water.

Specifically, the first refrigerant circulation unit includes the outdoor heat exchanger 13, a first compressor compressing the first refrigerant, a first expansion unit 14 expanding the first refrigerant, a first flow switch 12 switching a flow direction of the first refrigerant, an intermediate heat exchanger 25 exchanging heat between the first refrigerant and the second refrigerant, and a first refrigerant pipe 15. That is, the first refrigerant performs the refrigerant cycle while sequentially circulating any one of the first compressor 11, the outdoor heat exchanger 13, and the intermediate heat exchanger 25 and the other one of the first expansion unit 14, the outdoor heat exchanger 13, and the intermediate heat exchanger. Further, by the first flow switch 12, the flow direction of the first refrigerant may be switched into a direction in which the first refrigerant is introduced into the outdoor heat exchanger 13 from the intermediate heat exchanger 25 through the first expansion unit 14 or a reverse direction.

In addition, the second refrigerant circulation unit includes the intermediate heat exchanger 25, a second compressor 21 compressing the second refrigerant, a second expansion unit 24 expanding the second refrigerant, a second flow switch 22 switching a flow direction of the second refrigerant, the water refrigerant heat exchanger 23, and a second refrigerant pipe 26. That is, the second refrigerant performs the refrigerant cycle while sequentially circulating any one of the second compressor 21, the intermediate heat exchanger 25, and the water refrigerant heat exchanger 23 and the other one of the second expansion unit 24, the intermediate heat exchanger 25, and the water refrigerant heat exchanger 23. Further, by the second flow switch 22, the flow direction of the second refrigerant may be switched into a direction in which the second refrigerant is introduced into the intermediate heat exchanger 25 from the water refrigerant heat exchanger 23 through the second expansion unit 24 or a reverse direction.

At this time, the intermediate heat exchanger 25 through which the first referent, second refrigerant, and water pass at the same time is included in the first refrigerant circulation unit or included in the second refrigerant circulation unit. In addition, in the intermediate heat exchanger 25, three flow passages 251, 252, and 253 for allowing the first refrigerant, second refrigerant, and water to flow, respectively are formed. Accordingly, in the intermediate heat exchanger 25, the first refrigerant, second refrigerant, and water exchange heat with each other at the same time. That is, the intermediate heat exchanger 25 serves as the water refrigerant heat exchanger where the heat is exchanged between the water and the water in a functional sense.

In another aspect, the intermediate heat exchanger 25 may serve as a first water refrigerant heat exchanger where the heat is exchanged between the first refrigerant and the water and the water refrigerant heat exchanger 23 may serve as a second water refrigerant heat exchanger where the heat is exchanged between the second refrigerant and the water.

Meanwhile, the outdoor heat exchanger 13, the first compressor 11, the first expansion unit 14, and the first flow switch 12 are installed in the outdoor unit 1. In the case where the outdoor unit 1 is operated in a cooling mode, the outdoor heat exchanger 13 serves as the condenser and serves as the evaporator in the case where the outdoor unit 1 is operated in a hating mode.

In addition, the intermediate heat exchanger 25, the water refrigerant heat exchanger 23, the second compressor 21, and the second flow switch 22 are installed in the intermediator 2. Moreover, in the intermediator 2, the water refrigerant heat exchanger 23, a flow switch 32 that is mounted on a water pipe 61 extending to the outlet of the water refrigerant heat exchanger 23 and senses the flow of the water, an expansion tank 33 branched from any point separated from the flow switch 32 in the flow direction of the water, a water collection tank 34 into which the end of the water pipe 61 extending from the outlet of the water refrigerant heat exchanger 23 is inserted and which an auxiliary heat 35 is provided, and a water pump 36 provided at any point of the water pipe 61 of the outlet side of the water collection tank 34.

More specifically, the water refrigerant heat exchanger 23 may adopt, for example, a plate-type heat exchanger as a device where the heat is exchanged between refrigerant that flows on a closed circuit of the refrigerant cycle and water that flows on the water pipe 61. At least two flow passages 231 and 232 where the refrigerant and the water independently flow and exchange the heat are formed in the water refrigerant heat exchanger 23.

Further, when the volume of water heated while passing through the water refrigerant heat exchanger 23 is expanded at an appropriate level or more, the expansion tank 33 performs an absorption function to absorb the expansion.

Further, the water collection tank 34 is a container where the water passing through the water refrigerant heat exchanger 23 is collected. In addition, the auxiliary heat 35 is mounted in the water collection tank 34, such that the auxiliary heat 35 is selected operated in the case where a heat quantity transferred through the water refrigerant heat exchanger 23 does not reach a required heat quality like a case where a defrosting operation is performed.

In addition, an air vent 343 is formed on the top of the water collection tank 34 to discharge air of an overheat state that exists in the water collection tank 34. Moreover, a pressure gauge 341 and a relief valve 342 are provide at one portion of the water collection tank 34, such that the internal pressure of the water collection tank 34 may appropriately be controlled. For example, when the internal water pressure of the water collection tank 34 displayed through the pressure gauge 341 is excessively high, the relief valve 342 is opened to appropriately control the internal pressure of the tank.

Further, the water pump 36 pumps water discharged through the water pip 61 extending from the outlet of the water collection tank 34 to supply it to a hot water supplying unit 4 and a cooling/heating unit 5.

Meanwhile, the water circulation unit includes the hot water supplying unit 4 where water for supplying hot water, that is, hot water supplying flows and the cooling/heating unit 5 where water for indoor cooling and heating flows.

More specifically, the hot water supplying unit 4 is a part heating and supplying water required for an operation such as user's washing or dish-washing. Specifically, a three-way valve 71 controlling the flow of the water is provided at any point separated from the water pump 36 in the flow direction of the water. The three-way valve 71 is a direction change valve that allows the water pumped by the water pump 36 to flow to the hot water supplying unit 4 or the cooling/heating unit 5. Accordingly, each of a hot water supplying pipe 62 extending to the hot water supplying unit 4 and the cooling/heating pipe 63 extending to the cooling/heating unit 5 are connected to the outlet of the three-way valve 71. In addition, the water pumped by the water pump 36 selectively flows to any one of the hot water supplying pipe 62 or the cooling/heating pipe 63 by the control of the three-way valve 71.

A hot water supplying tank 41 that stores water supplied from the outside and heats the stored water and an auxiliary heat 42 that is provided in the hot water supplying tank 41 are included in the hot water supplying unit 4. In addition, a water introduction portion 411 for introducing cooling water and a water discharge portion 412 for discharging heated water are provided on one side of the hot water supplying unit.

Specifically, a part of the hot water supplying pipe 62 extending from the three-way valve 71 is inputted into the hot water supplying tank 41 and heats the water stored in the hot water supplying tank 41. That is, heat is transmitted from high-temperature water that flows along the inside of the hot water supplying pipe 62 to the water stored in the hot water supplying tank 41. In addition, in a predetermined case, the auxiliary heat 35 and the auxiliary heat source operate to further supply additional heat. For example, like a case where the user needs a lot of water to take a bath, they may operate when the water needs to be heated within a short time. According to the embodiment, a water discharge device such as a shower or a home appliance device such as a humidifier may be connected to the water discharge unit 412.

Meanwhile, the cooling/heating unit 5 includes a floor cooling/heating unit 51 formed by burying a part of the cooling/heating pipe 63 in an indoor floor and an air cooling/heating unit 52 that is branched from any one point of the cooling/heating pipe 63 and in parallel, connected with the floor cooling/heating unit 51.

Specifically, the floor cooling/heating unit 51 may be buried in the indoor floor in the form of a meander line as shown in the figure. In addition, the air cooling/heating unit 52 may be a fan coil unit or a radiator. Further, in the air cooling/heating unit 52, a part of the air cooling/heating pipe 54 branched from the cooling/heating pipe 63 is provided as a heat exchange means. Moreover, a flow passage switching valve 56 such as the three-way valve 71 is installed at a point where the air cooling/heating pipe 54 is branched and refrigerant that flows on the cooling/heating pipe 63 flows by being divided into the floor cooling/heating unit 51 and the air cooling/heating unit 52 or flows to only any one of the floor cooling/heating unit 51 and the air cooling/heating unit 52.

Further, an end portion of the hot water supplying pipe 62 extending from the three-way valve 71 is united at a point separated from an outlet of the air cooling/heating pipe 54 in the flow direction of the water. Therefore, in a hot water supplying mode, the refrigerant that flows on the hot water supplying pipe 62 is combined into the cooling/heating pipe 63 again and thereafter, is introduced into the water refrigerant heat exchanger 23.

Herein, like a point where the hot water supplying 62 is combined with the cooling/heating pipe 63, a check valve V is installed at a point requiring backflow prevention to prevent the backflow of the water. In the same context, except for a method of installing the flow passage switching valve 56, the check valve will be able to be installed at each of the outlet of the air cooling/heating pipe 54 and the outlet of the floor cooling/heating unit 51.

Meanwhile, the water pipe 61 guides the flow of the water for performing any one of the hot water supplying and the indoor cooling/heating. The water pipe 61 includes the hot water supplying pipe 62 guiding the water discharged from the water pump 36 to the hot water supplying unit 4, the cooling/heating pipe 63 guiding the water discharged from the water pump 36 to the cooling/heating unit 5, a main pipe 302 connecting the water refrigerant heat exchanger and the water pump with each other, and a branch pipe 303 branched from the main pipe 302 in order to the water passing through any one of the hot water supplying unit 4 and the cooling/heating unit 5 to the intermediate heat exchanger 25. One end of the branch pipe 303 is connected to one corresponding point of the main pipe 302 between the point where the hot water supplying pipe 62 and the cooling/heating pipe 63 are combined and the water refrigerant heat exchanger 23 and the other end of the branch pipe 303 is connected to the other point of the main pipe 303 corresponding to a discharge side of the water refrigerant heat exchanger.

At this time, the water circulation system associated with the refrigerant cycle further includes a first flow control unit 304 selectively preventing the flow of the water to the intermediate heat exchanger 25 and a second flow control unit 306 selectively preventing the flow of the water to the water refrigerant heat exchanger 23. The first flow control unit 304 is installed at one point of the branch pipe 303 corresponding to an inlet of the intermediate heat exchanger and the second flow control unit 306 is installed at one point of the main pipe 302 corresponding to a downstream side of the point where the branch pipe 303 is branched.

The first flow control unit 304 and the second flow control unit 306 serves to control a flowing amount of the water passing through the hot water supplying unit 4 and the cooling/heating unit 5 to the intermediate heat exchanger 25 and the water refrigerant heat exchanger 23, respectively.

Hereinafter, the flow of refrigerant in a first embodiment of a water circulation system associated with a refrigerant cycle according to the present invention will be described in detail with reference to the accompanying drawings.

Figure 2:
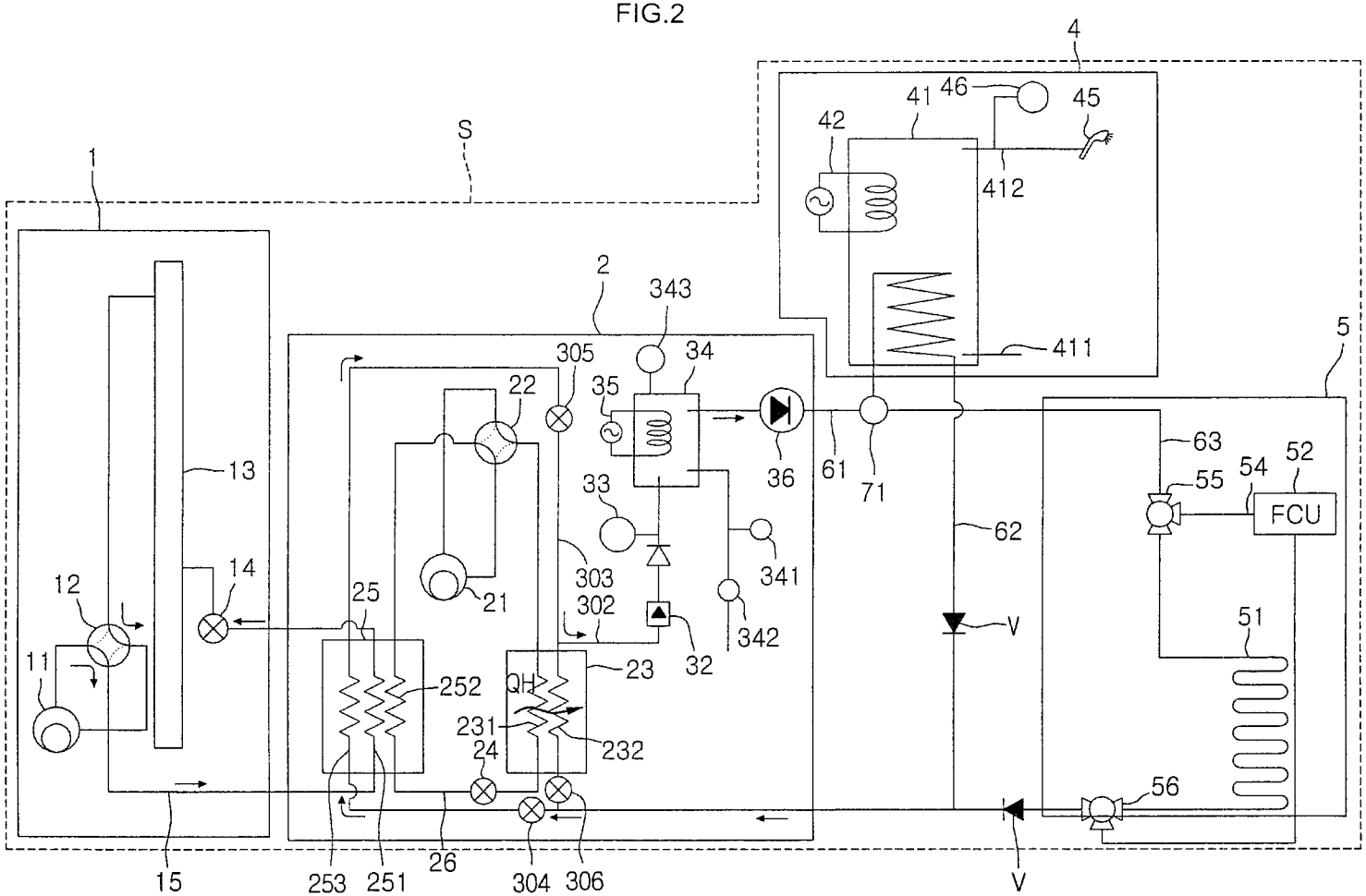
FIG. 2 is a diagram showing the flow of refrigerant when a first embodiment of a water circulation system associated with a refrigerant cycle according to the present invention is driven in one-stage compression type.
Figure 3:
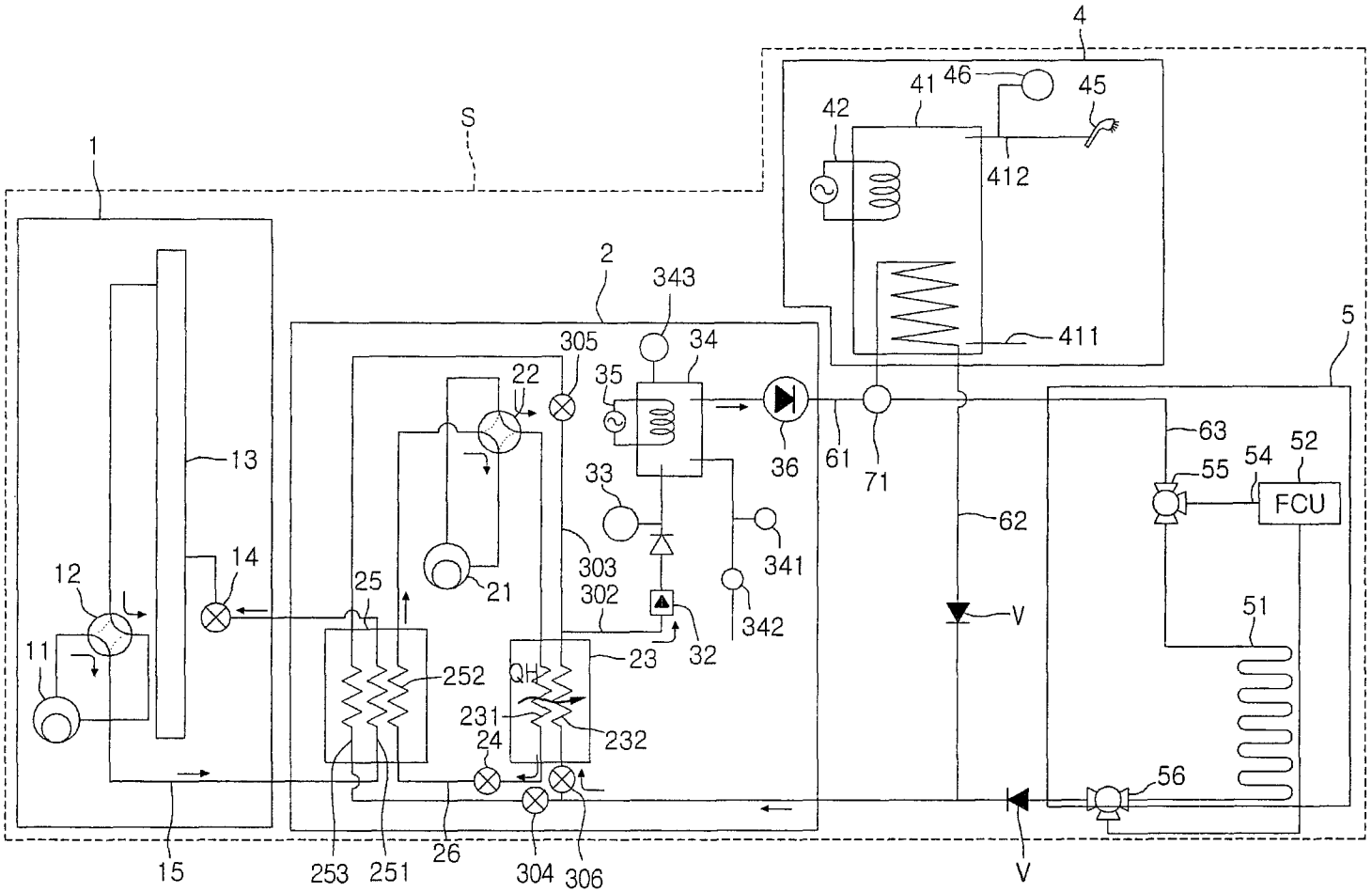
FIG. 3 is a diagram showing the flow of refrigerant when a first embodiment of a water circulation system associated with a refrigerant cycle according to the present invention is driven in two-stage compression type.
Figure 4:
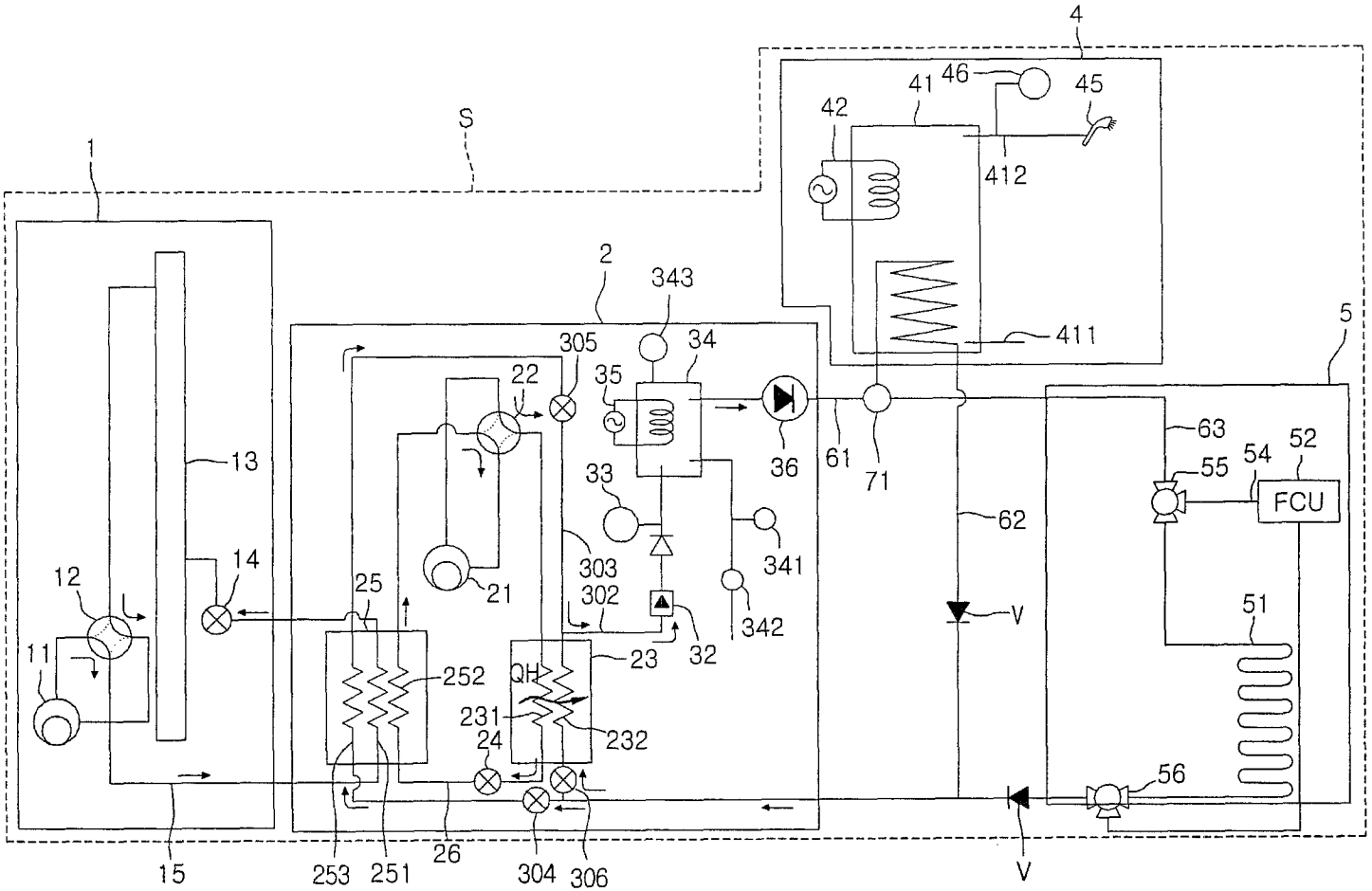
FIG. 4 is a diagram showing the flow of refrigerant when a first embodiment of a water circulation system associated with a refrigerant cycle according to the present invention is driven in one-stage and two-stage mixed compression type.

FIG. 2 is a diagram showing the flow of refrigerant when a first embodiment of a water circulation system associated with a refrigerant cycle according to the present invention is driven in one-stage compression type, FIG. 3 is a diagram showing the flow of refrigerant when a first embodiment of a water circulation system associated with a refrigerant cycle according to the present invention is driven in two-stage compression type, and FIG. 4 is a diagram showing the flow of refrigerant when a first embodiment of a water circulation system associated with a refrigerant cycle according to the present invention is driven in one-stage and two-stage mixed compression type.

Referring to FIGS. 2 to 4, first, the flow of the refrigerant when the water circulation system S associated with the refrigerant cycle operates in a heating mode will be described. The water circulation system S associated with the refrigerant cycle can perform a heating operation in three operation states such as the one-stage compression operation, the two-stage compression operation, and the mixed operation.

Herein, the one-stage compression operation means an operation state in which the water that flows in any one of the hot water supplying unit 4 and the cooling/heating unit is heated by the first refrigerant. The two-stage compression operation means an operation state in which the water that flows in any one of the hot water supplying unit 4 and the cooling/heating unit 5 is heated by the second refrigerant. In addition, the mixed operation means an operation state in which the water that flows in any one of the hot water supplying unit 4 and the cooling/heating unit is heated by the first refrigerant and the second refrigerant at the same time.

That is, in the one-stage compression operation, the water is heated by a single refrigerant cycle performed by the first refrigerant. In addition, in the two-stage compression operation, the second refrigerant is heated by a first refrigerant cycle performed by the first refrigerant and the water is heated by a second refrigerant cycle performed by the second refrigerant. Further, in the mixed operation, the water is heated by two refrigerant cycles performed by the first refrigerant and the second refrigerant at the same time.

More specifically, referring to FIG. 2, first, the flow of the refrigerant when the water circulation system S associated with the refrigerant cycle operates in the one-stage compression type will be described.

In the first refrigerant circulation unit, while the first refrigerant discharged from the first compressor 11 sequentially passes through the intermediate heat exchanger 25, the first expansion unit 14, and the outdoor heat exchanger 13, the refrigerant cycle is performed. At this time, the first flow switch 12 maintains a state to guide the refrigerant discharged from the first compressor 11 to the intermediate heat exchanger 25.

In addition, in the second refrigerant circulation unit, the flow of the refrigerant is stopped. That is, the operation stop of the second compressor 21 is maintained.

Further, in the water circulation unit, the water discharged from the water pump 36 is introduced into any one of the hot water supplying unit 4 and the cooling/heating unit 5. The water passing through any one of the hot water supplying unit 4 and the cooling/heating unit 5 is introduced into the branch pipe 303. At this time, the second flow control unit 305 maintains a closed state to prevent the flow of the water to the water refrigerant heat exchanger 23. Further, the first flow control unit 304 and the second flow control unit 305 maintain an opened state.

In addition, the water introduced into the branch pipe 303 passes through the intermediate heat exchanger 25. While the water passes through the intermediate heat exchanger 25, the water is heated by exchange the heat with the first refrigerant. The water passing through the intermediate heat exchanger 25 is again introduced into the water pump 36 through the water collection tank 34.

Next, referring to FIG. 3, first, the flow of the refrigerant when the water circulation system S associated with the refrigerant cycle operates in the two-stage compression type will be described.

In the first refrigerant circulation unit, the flow of the first refrigerant is the same as the case where the water circulation system S associated with the refrigerant cycle operates in the one-stage compression type.

In addition, in the second refrigerant circulation unit, the second refrigerant discharged from the second compressor 21 is introduced into the water refrigerant heat exchanger 23. While the second refrigerant introduced into the water refrigerant heat exchanger 23 passes through the water refrigerant heat exchanger 23, the second refrigerant emits the heat to the water. In addition, the second refrigerant passing through the water refrigerant heat exchanger 23 is expanded while passing through the second expansion unit 24 and thereafter is introduced into the intermediate heat exchanger 25. While the second refrigerant passes through the intermediate heat exchanger 25, the second refrigerant absorbs the heat from the first refrigerant and thereafter, is again introduced into the second compressor 21. At this time, the second flow switch guides the second refrigerant discharged from the second compressor 21 to the water refrigerant heat exchanger 23 and guides the refrigerant passing through the intermediate heat exchanger 25 to the second compressor 21.

Further, in the water circulation unit, the water discharged from the water pump 36 is introduced into any one of the hot water supplying unit 4 and the cooling/heating unit 5. The water passing through any one of the hot water supplying unit 4 and the cooling/heating unit 5 is introduced into the main pipe 302. At this time, the first flow control unit 304 maintains the closed state to prevent the flow of the water to the intermediate heat exchanger 25. Further, the second flow control unit 306 maintains the opened state.

In addition, the water introduced into the main pipe 302 passes through the water refrigerant heat exchanger 23. While the water passes through the water refrigerant heat exchanger 23, the water is heated by exchange the heat with the second refrigerant. The water passing through the water refrigerant heat exchanger 23 is again introduced into the water pump 36 through the water collection tank 34.

In addition, referring to FIG. 4, the flow of the refrigerant when the water circulation system S associated with the refrigerant cycle operates in the mixed compression type will be described.

In the first refrigerant circulation unit and the second refrigerant circulation unit, the flows of the first refrigerant and the second refrigerant are the same as the case where the water circulation system S associated with the refrigerant cycle operates in the two-stage compression type.

However, in the water circulation unit, the water discharged from the water pump 36 is introduced into any one of the hot water supplying unit 4 and the cooling/heating unit 5. The water passing through any one of the hot water supplying unit 4 and the cooling/heating unit 5 is introduced into the main pipe 302 and the branch pipe 303 at the same time. At this time, both the first flow control unit 304 and the second flow control unit 306 maintain the opened state.

The water introduced into the main pipe 302 and the water introduced into the branch pipe 303 pass through the water refrigerant heat exchanger 23 and the intermediate heat exchanger 25, respectively. While the water passes through the intermediate heat exchanger 25, the water is heated by exchanging the heat with the first refrigerant and while the water passes through the water refrigerant heat exchanger 23, the water is heated by exchanging the heat with the second refrigerant. That is, the water is heated by the first refrigerant and the second refrigerant at the same time.

In addition, the water passing through the water refrigerant heat exchanger 23 and the intermediate heat exchanger 25 is again introduced into the water pump 36 through the water collection tank 34.

Next, in the case where the water circulation system S associated with the refrigerant cycle operates in the cooling mode, the first refrigerant and the second refrigerant flow in reverse order in the first refrigerant circulation unit and the second refrigerant circulation unit in comparison with the case where the system operates in the heating mode.

Hereinafter, the shape of an intermediate heat exchanger in a first embodiment of a water circulation system associated with a refrigerant cycle according to the present invention will be described in detail with reference to the accompanying drawings.

Figure 5:
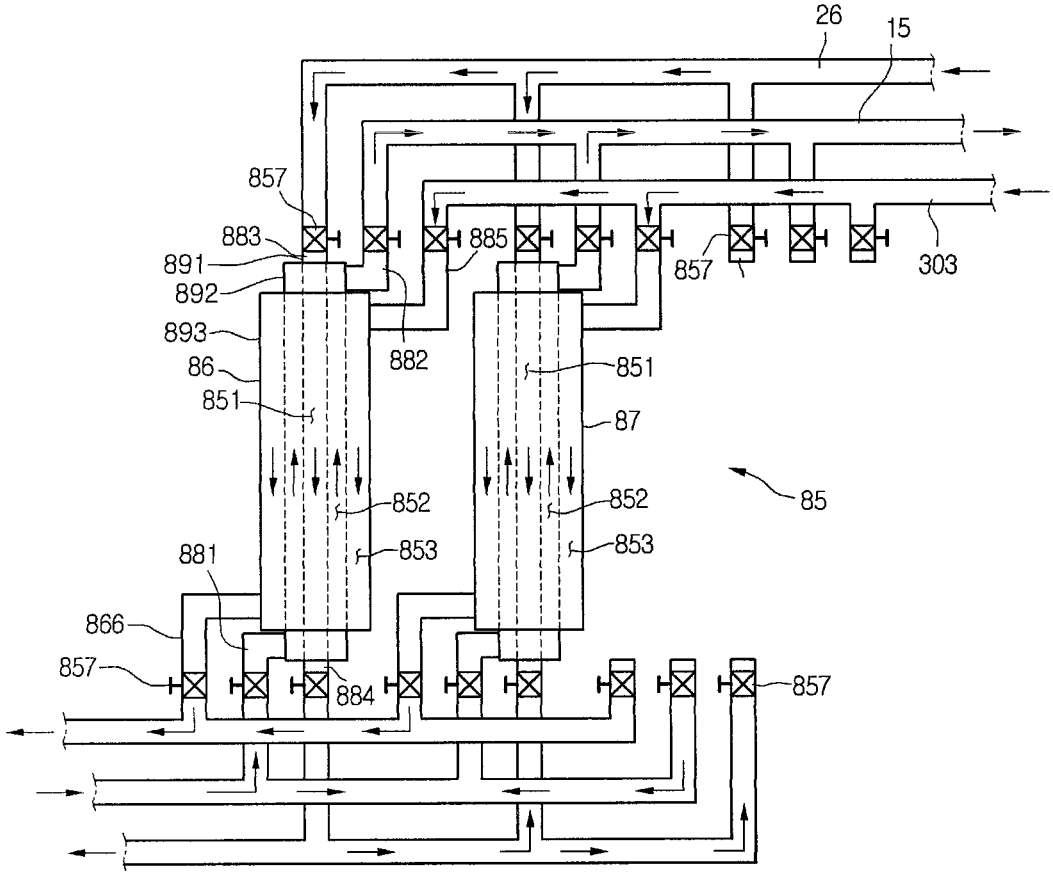
FIG. 5 is a configuration diagram of the configuration of an intermediate heat exchanger in a first embodiment of a water circulation system associated with a refrigerant cycle according to the present invention.
Figure 6:
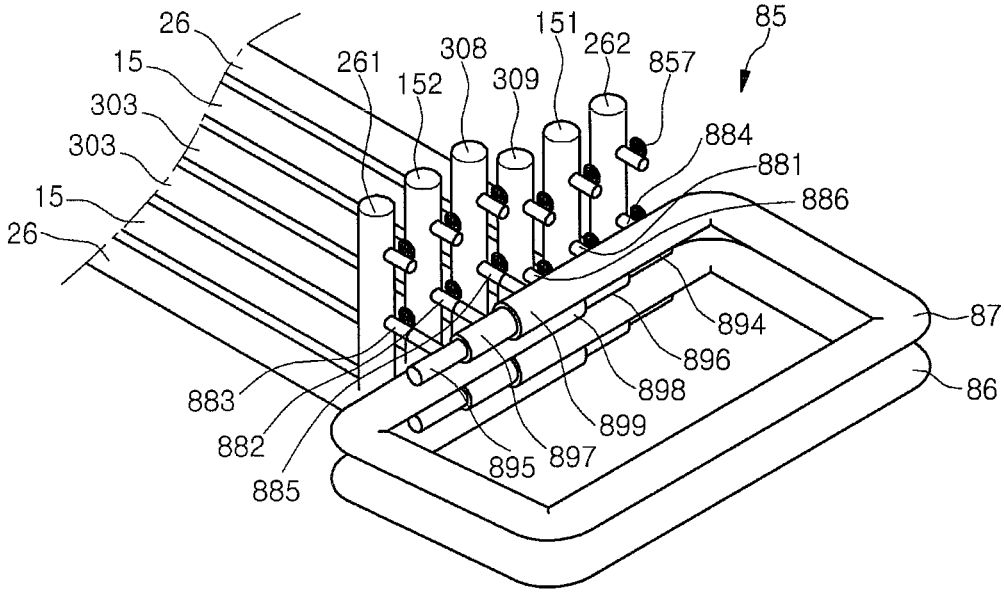
FIG. 6 is a configuration diagram of the shape of an intermediate heat exchanger in a first embodiment of a water circulation system associated with a refrigerant cycle according to the present invention.

FIG. 5 is FIG. 5 is a configuration diagram of the configuration of an intermediate heat exchanger in a first embodiment of a water circulation system associated with a refrigerant cycle according to the present invention and FIG. 6 is a configuration diagram of the shape of an intermediate heat exchanger in a first embodiment of a water circulation system associated with a refrigerant cycle according to the present invention.

Referring to FIGS. 5 and 6, the intermediate heat exchanger 85 is a triple pipe 85 in which three independent flow passages 851, 852, and 853 are formed by three pipes having a concentric axis and different diameters.

Specifically, the intermediate heat exchanger 85 includes a first flow passage 851 positioned at the innermost side on the basis of the concentric axis, a second flow passage 852 positioned outside of the first flow passage 851, and a third flow passage 853 positioned outside of the second flow passage 852. The first flow passage 851 is in communication with a second refrigerant pipe 26 through which second refrigerant flows, the second flow passage 852 is in communication with a first refrigerant pipe 15 through which first refrigerant flows, and the third flow passage 853 is in communication with a water pipe 303 through which water flows. That is, the second refrigerant flows through the first flow passage 851, the first refrigerant flows through the second flow passage 852, and the water flows through the third flow passage 853.

On the other hand, the intermediate heat exchanger 85 includes a plurality of heat exchanging units 86 and 87 that are removably connected with each other. The heat exchanging units 86 and 87 each include three flow passages 851, 852, and 853.

Further, the plurality of heat exchanging units 86 and 87 each include three pipes 891, 892, and 893. Three pipes 891, 892, and 893 include a first pipe positioned at the innermost side among three pipes 891, 892, and 893, a second pipe 892 positioned outside of the first pipe 891, and a third pipe 893 positioned outside of the second pipe 892. That is, the first pipe 891 is housed in the second pipe 892 and the first pipe 891 and the second pipe 892 are housed in the third pipe 893.

At this time, the inside of the first pipe 891 corresponds to the first flow passage 851, a space corresponding between the first pipe 891 and the second pipe 892 corresponds to the second flow passage 852, and a space corresponding between the second pipe 892 and the third pipe 893 corresponds to the third flow passage 853.

In addition, each of the heat exchanging units 86 and is connected to the first refrigerant pipe 15, the second refrigerant pipe 26, and the water pipe 303.

At this time, a plurality of introduction portions 881, 883, and 885 and refrigerant discharge portions 882, 884, and 886 that are selectively connected to each of the plurality of heat exchanging units 86 and 87 are provided in the first refrigerant pipe 15, the second refrigerant pipe 26, and the water pipe 303. More specifically, the plurality of introduction portions 881, 883, and 885 and refrigerant discharge portions 882, 884, and 886 include a first refrigerant introduction portion 881 and a first refrigerant discharge portion 882 for introducing and discharging the first refrigerant, a second refrigerant introduction portion 883 and a second refrigerant discharge portion 884 for introducing and discharging the second refrigerant, and a water introduction portion 885 and a water discharge portion 886 for introducing and discharging the water.

In addition, each of the plurality of introduction portion 881, 883, and 885 and discharge portions 882, 884, and 886 includes a plurality of flow preventing portions 857 for selectively shielding the plurality of introduction portion 881, 883, and 885 and discharge portions 882, 884, and 886. The plurality of flow preventing portions 857 selectively prevents the flow of at least one of the first refrigerant, the second refrigerant, and the water through the plurality of introduction portion 881, 883, and 885 and discharge portions 882, 884, and 886.

Meanwhile, the heat exchanging units 86 and 87 have a tube shape wound up spirally. In addition, both end portions of the heat exchanging units 86 and 87 are connected to the first refrigerant pipe 15, the second refrigerant pipe 26, and the water pipe 303.

More specifically, the heat exchanging units 86 and 87 have a shape in which one end portion is bent four times in the same direction and the other end portion is wound up to be positioned at an upper portion of the one end portion. End portions 894, 896, and 898 of the heat exchanging units 86 and 87 are connected to the first refrigerant introduction portions 881, 883, and 885 and 881 and the second refrigerant discharge portions 882, 884, and 886 and 884, and the water discharge portions 882, 884, and 886 and 886 of the water pipe 303. In addition, the other end portions 895, 897, and 899 of the heat exchanging units 86 and 87 are connected to the first refrigerant discharge portions 882, 884, and 886 and 882 of the first refrigerant pipe 15, the second refrigerant introduction portions 881, 883, and 885 and 883 of the second refrigerant pipe 15, and the water introduction portions 881, 883, and 885 and 885 of the water pipe 303.

Further, in the heat exchanging units 86 and 87, both end portions 896 and 897 of eh second pipe 892 extend from both end portions 898 and 899 of the third pipe 893 to the outside and both end portions 894 and 895 of the first pipe 891 extend from both end portions 896 and 897 of the second pipe 892 to the outside. Accordingly, both end portions 894, 895, 896, 897, 898, and 899 of the first pipe 891, the second pip 892, and the third pipe 893 may all be exposed to the outside.

At this time, the end portion 894 of the first pipe 891 exposed to the outside is connected to the second refrigerant discharge portions 882, 884, and 886 and 884 and the other end portion 895 is connected to the second refrigerant introduction portions 881, 883, and 885 and 883. In addition, the end portion 896 of the second pipe 892 exposed to the outside is connected to the first refrigerant introduction portions 881, 883, and 885 and 881 and the other end portion 897 is connected to the first refrigerant discharge portions 881, 882, and 884 and 886 and 882. Further, the end portion of the third pipe 893 exposed to the outside is connected to the water introduction portions 881, 883, and 885 and 885 and the other end portion 899 is connected to the water discharge portions 882, 884, and 886 and 886.

Each of the first refrigerant pipe 15, the second refrigerant pipe 15, and the water pipe 303 includes introduction pipes 151, 261, and 308 for introducing the first refrigerant, the second refrigerant, and the water into the heat exchanging unit 86 and 87 and discharge pipes 152, 262, and 309 for discharging the first refrigerant, the second refrigerant, and the water to the heat exchanging unit 86 and 87.

The introduction pipes 151, 261, and 308 and the discharge pipes 152, 262, and 309 of the first refrigerant pipe 15, the second refrigerant pipe 26, and the water pipe 303 are positioned in the rear of the heat exchanging units 86 and 87 in a row in a vertical direction. At this time, the introduction pipes 151, 261, and 308 and the discharge pipes 152, 262, and 309 of the first refrigerant pipe 15, the second refrigerant pipe 26, and the water pipe 303 are arranged to correspond to the exposed positions of the both end portions 894, 895, 896, 897, 898, and 899 of the first pipe 891, the second pipe 892, and the third pipe 893.

That is, the both end portions 894, 895, 896, 897, 898, and 899 of the first pipe 891, the second pipe 892, and the third pipe 893 are positioned in the order of the end portion 894 of the first pipe 891, the end portion 896 of the second pipe 892, the end portion 898 of the third pipe 893, the other end portion of the third pipe 893, the other end portion 897 of the second pipe 892, and the other end portion 899 of the first pipe 891. Accordingly, the introduction pipes 151, 261, and 308 and the discharge pipes 152, 262, and 309 of the first refrigerant pipe 15, the second refrigerant pipe 26, and the water pipe 303 are arranged in the order of the discharge pipe 262 of the second refrigerant pipe 26, the introduction pipe 151 of the first refrigerant pipe 15, the discharge pipe 309 of the water pipe 303, the introduction pipe 308 of the water pipe 303, the discharge pipe 152 of the first refrigerant pipe 15, and the introduction pipe of the second refrigerant pipe 26.

In addition, the introduction pipes 151, 261, and 308 and the discharge pipes 152, 262, and 309 each include the plurality of introduction portions 881, 883, and 885 and discharge portions 882, 884, and 886. The introduction portion 881 and the discharge portions 884 and 886 corresponding to the end portion of the heat exchanging units 86 and 87 are positioned lower than the introduction portions 883 and 885 and the discharge portion 882 corresponding to the other end portion of the heat exchanging units 86 and 87 by a difference in height between the end portion and the other end portion. The introduction portion 881 and the discharge portions 884 and 886 corresponding to the end portion of the heat exchanging units 86 and 87 cross the introduction portions 883 and 885 and the discharge portion 882 corresponding to the other end portion of the heat exchanging units 86 and 87.

Meanwhile, the heat exchange capacity of the intermediate heat exchanger 85 may be varied depending on the number of the heat exchanging units 86 and 87 connected to the first refrigerant pipe 15, the second refrigerant pipe 26, and the water pipe 303. Further, as the flow of the refrigerant to the plurality of heat exchanging units 86 and 87 is selectively prevented by the plurality of flow preventing portions 857, the heat exchange capacity of the intermediate heat exchanger 85 may be varied.

More specifically, since the heat exchanging units 86 and 87 are selectively and removably connected to the introduction portions 881, 883, and 885 and the discharge portions 882, 884, and 886, the heat exchanging unit 86 and 87 may be connected to the introduction portions 881, 883, and 885 and the discharge portions 882, 884, and 886 by changing the number of connected portions as necessary.

Further, by preventing the flow of the first refrigerant, the second refrigerant, and the water to the heat exchanging units 86 and 87 by means of the flow preventing portion 857 even in the state where the heat exchanging units 86 an 87 are connected to the introduction portions 881, 883, and 885 and the discharge portions 882, 884, and 886, the number of the heat exchanging units 86 and 87 substantially used for exchanging the heat may be varied. By this method, the entire heat exchanging capacity of the intermediate heat exchanger 85 may be varied.

Meanwhile, the type in which the first refrigerant, the second refrigerant, and the water flows through three flow passages 851, 852, and 853 has various numbers of cases. That is, the first refrigerant flows through any one of three flow passages 851, 852, and 853, the second refrigerant flows through another of three flow passages 851, 852, and 853, and the water flows through the other one of three flow passages 851, 852, and 853. Accordingly, the first refrigerant, the second refrigerant, and the water may flow through three flow passages 851, 852, and 853 in six types.

More specifically, as a first type of six types, the first refrigerant may flow through the first flow passage 851, the second refrigerant may flow through the second flow passage 852, and the water may flow through the third flow passage 853.

More specifically, as a second type of six types, the first refrigerant may flow through the first flow passage 851, the second refrigerant may flow through the third flow passage 853, and the water may flow through the second flow passage 852.

In addition, as a third type of six types, the first refrigerant may flow through the second flow passage 852, the second refrigerant may flow through the first flow passage 851, and the water may flow through the third flow passage 853.

Next, as a fourth type of six types, the first refrigerant may flow through the second flow passage 852, the second refrigerant may flow through the third flow passage 853, and the water may flow through the first flow passage 851.

Further, as a fifth type of six types, the first refrigerant may flow through the third flow passage 853, the second refrigerant may flow through the first flow passage 851, and the water may flow through the second flow passage 852.

Finally, as a sixth type of six types, the first refrigerant may flow through the third flow passage 853, the second refrigerant may flow through the second flow passage 852, and the water may flow through the first flow passage 851.

Further, the flow directions of fluids that flow through adjacent flow passages among the fluids that flow through three flow passages 851, 852, and 853 are opposite to each other. At this time, the fluids include the first refrigerant, the second refrigerant, and the water.

More specifically, the first fluid that flows through the first flow passage 851 and the third fluid that flows through the third flow passage 853 flow in a direction opposite to the flow direction of the second fluid that flows through the second flow passage 852. The first fluid, second fluid, and third fluid may be the first refrigerant, second refrigerant, and water. That is, two fluids that flow adjacent to each other among the first refrigerant, the second refrigerant, and the water flow opposite to each other in the intermediate heat exchanger 85. Accordingly, the heat exchange efficiency of the intermediate heat exchanger 85 can further be improved.

Hereinafter, an operation of an embodiment of a water circulation system associated with a refrigerant cycle according to the present invention will be described.

Referring to FIGS. 4 and 5, while using the water circulation system associated with the refrigerant cycle, the heat exchange capacity of the intermediate heat exchanger 85 may need to be varied according to circumstances. In this case, it is possible to vary the heat exchange capacity of the intermediate heat exchanger 85 by using two methods.

As a first method, depending on the number of connected units among the plurality of heat exchanging units 86 and 87 in the intermediate heat exchanger 85, the heat exchange capacity of the intermediate heat exchanger 85 may be varied. That is, by changing the number of the heat exchanging units connected to the first refrigerant pipe 15, the second refrigerant pipe 26, and the water pipe 303, the heat exchange capacity of the intermediate heat exchanger 85 may be varied.

More specifically, in the case where the heat exchange capacity of the intermediate heat exchanger 85 needs to be reduced, first, the flow preventing portions 857 corresponding to any one of the heat exchanging units coupled to the intermediate heat exchanger 85 are all closed. Next, by a method of separating any one heat exchanging unit, it is possible to reduce the heat exchange capacity of the intermediate heat exchanger 85.

On the contrary, in the case where the heat exchange capacity of the intermediate heat exchanger 85 needs to be increased, first, the heat exchanging unit is coupled to the introduction portions 881, 883, and 885 and the discharge portions 882, 884, and 886. Next, by a method of opening the flow preventing portions 857 of the introduction portions 881, 883, and 885 and the discharge portions 882, 884, and 886, the heat exchange capacity of the intermediate heat exchanger 85 may be increased.

As a second method, as the flow of the refrigerant to the plurality of heat exchanging units 86 and 87 is selectively prevented by the plurality of flow preventing portions 857, the heat exchange capacity of the intermediate heat exchanger 85 may be varied.

More specifically, in the case where the heat exchange capacity of the intermediate heat exchanger 85 needs to be reduced, first, by closing the flow preventing portion 857 corresponding to any one of the heat exchanging units coupled to the intermediate heat exchanger 85, the heat exchange capacity of the intermediate heat exchanger 85 may be reduced.

In the case where the heat exchange capacity of the intermediate heat exchanger 85 needs to be increased, first, by opening the flow preventing portion 857 corresponding to a heat exchanging unit where the flow is prevented among the heat exchanging units coupled to the intermediate heat exchanger 85, the heat exchange capacity of the intermediate heat exchanger 85 may be increased.

By the water circulation system associated with the refrigerant cycle, the first refrigerant, the second refrigerant, and the water can exchange the heat with each other at the same time. Further, the heat may selectively be exchanged between two of the first refrigerant, the second refrigerant, and the water as necessary.

In addition, it is possible to vary the heat exchange capacity of the intermediate heat exchanger 85 by using various methods as necessary.

What is claimed is:

1. A system for circulating water and refrigerant, the system comprising:

a first refrigerant circulation device in which a first refrigerant that exchanges heat with outdoor air flows through a first tube to perform a refrigerant cycle, the first refrigerant circulation device including a first compressor, an outdoor heat exchanger, and a first expander;

a second refrigerant circulation device in which a second refrigerant that exchanges heat with the first refrigerant flows through a second tube to perform the refrigerant cycle, the second refrigerant circulation device including a second compressor and a second expander;

a water circulation device in which water flows through a water tube to at least one of perform indoor air conditioning or supply hot water;

an intermediate heat exchanger which comprises the first tube, the second tube, and the water tube, the intermediate heat exchanger including a plurality of flow passages through which the first refrigerant of the first refrigerant circulation device, the second refrigerant of the second refrigerant circulation device, and the water of the water circulation device independently flow, the plurality of flow passages having a common axis and different diameters in order to exchange heat among the first refrigerant, the second refrigerant, and the water;

a water-refrigerant heat exchanger provided at one side of the intermediate heat exchanger, wherein the water-refrigerant heat exchanger includes a refrigerant flow passage into which the second refrigerant flows and a water flow passage into which the water that exchanges heat with the second refrigerant flows;

a plurality of inlets and outlets provided in the first tube, the second tube, and the water tube; and a plurality of valves installed at the plurality of inlets and outlets to selectively block the plurality of inlets and outlets, wherein the first compressor operates such that the first refrigerant discharged from the first compressor sequentially flows through the outdoor heat exchanger, the first expander, and one of the plurality of flow passages of the intermediate heat exchanger, and wherein the second compressor operates such that the second refrigerant discharged from the second compressor sequentially flows through another one of the plurality of flow passages of the intermediate heat exchanger, the second expander, and the refrigerant flow passage of the water-refrigerant heat exchanger.

2. The system of claim 1, wherein a heat exchange capacity of the intermediate heat exchanging devices exchanger varies depending on a number of operably connected devices among a plurality of heat exchanging devices of the intermediate heat exchanger.

3. The system of claim 1, wherein the plurality of inlets and outlets includes:

a first refrigerant introduction portion and a first refrigerant discharge portion that introduces and discharges the first refrigerant, respectively;

a second refrigerant introduction portion and a second refrigerant discharge portion that introduces and discharges the second refrigerant, respectively; and a water introduction portion and a water discharge portion that introduces and discharges the water, respectively.

4. The system of claim 1, further comprising a hot water supplying device that supplies hot water, wherein the water-refrigerant heat exchanger is coupled to the hot water supplying device to supply the water of the water circulation device to the hot water supplying device.

5. The system of claim 4, further comprising an auxiliary heater operably connected between the water-refrigerant heat exchanger and the hot water supplying device.

6. The system of claim 1, further comprising cooling and heating device that performs the indoor air conditioning, wherein the water-refrigerant heat exchanger is coupled to the cooling and heating device to supply the water of the water circulation device to the cooling and heating device.

7. The system of claim 6, further comprising an auxiliary heater provided between the water-refrigerant heat exchanger and cooling and heating device.

8. The system of claim 1, wherein the plurality of flow passages includes:

a first flow passage positioned at an innermost side on a basis of the common axis;

a second flow passage positioned outside of the first flow passage; and a third flow passage positioned outside of the second flow passage.

9. The system of claim 8, wherein the first refrigerant flows through the first flow passage, the second refrigerant flows through the second flow passage, and the water flows through the third flow passage.

10. The system of claim 8, wherein the first refrigerant flows through the first flow passage, the second refrigerant flows through the third flow passage, and the water flows through the second flow passage.

11. The system of claim 8, wherein the first refrigerant flows through the second flow passage, the second refrigerant flows through the first flow passage, and the water flows through the third flow passage.

12. The system of claim 8, wherein the first refrigerant flows through the second flow passage, the second refrigerant flows through the third flow passage, and the water flows through the first flow passage.

13. The system of claim 8, wherein the first refrigerant flows through the third flow passage, the second refrigerant flows through the first flow passage, and the water flows through the second flow passage.

14. The system of claim 8, wherein the first refrigerant flows through the third flow passage, the second refrigerant flows through the second flow passage, and the water flows through the first flow passage.

15. The system of claim 8, wherein flow directions of fluids that flow through adjacent flow passages among the fluids that flow through the first flow passage, the second flow passage, and the third flow passage are opposite to each other.

* * * * *